US011798740B2

(12) United States Patent
Yang et al.

(10) Patent No.: US 11,798,740 B2
(45) Date of Patent: Oct. 24, 2023

(54) METHOD OF IMPROVING COERCIVITY OF AN ARC-SHAPED ND-FE-B MAGNET

(71) Applicant: Yantai Shougang Magnetic Materials Inc, Shandong (CN)

(72) Inventors: Kunkun Yang, Shandong (CN); Chuanshen Wang, Shandong (CN); Zhongjie Peng, Shandong (CN); Kaihong Ding, Shandong (CN)

(73) Assignee: Yantai Shougang Magnetic Materials Inc, Yantai (CN)

( * ) Notice: Subject to any disclaimer, the term of this patent is extended or adjusted under 35 U.S.C. 154(b) by 604 days.

(21) Appl. No.: 17/100,975

(22) Filed: Nov. 23, 2020

(65) Prior Publication Data

US 2021/0166871 A1 Jun. 3, 2021

(30) Foreign Application Priority Data

Nov. 28, 2019 (CN) ..... 201911195484.9

(51) Int. Cl.

| | |
|---|---|
| ***H01F 41/02*** | (2006.01) |
| ***B41M 1/12*** | (2006.01) |
| ***H01F 1/057*** | (2006.01) |

(52) U.S. Cl.

CPC ..... *H01F 41/0293* (2013.01); *B41M 1/12* (2013.01); *H01F 1/0576* (2013.01); *H01F 41/0266* (2013.01)

(58) Field of Classification Search

CPC ..... H01F 41/0293; H01F 41/0266; H01F 1/0576; B41M 1/12

See application file for complete search history.

(56) References Cited

FOREIGN PATENT DOCUMENTS

| | | | | |
|---|---|---|---|---|
| CN | 103890880 A | * | 6/2014 | ..... C21D 9/46 |
| CN | 104465062 A | | 3/2015 | |
| CN | 204934604 U | | 1/2016 | |
| CN | 105845309 A | | 8/2016 | |
| FR | 2997095 A1 | | 4/2014 | |
| JP | 2009023126 A | | 2/2009 | |

* cited by examiner

*Primary Examiner* — Daniel McNally

(74) *Attorney, Agent, or Firm* — Gang Yu

(57) ABSTRACT

The disclosure relates to a method for improving the coercivity of an arc-shaped Nd—Fe—B magnet. A method for increasing the coercivity of an arc-shaped Nd—Fe—B magnet is provided. Said method comprises the steps of:

a) providing of a flexible film with a heavy rare earth coating thereon, wherein the heavy rare earth coating comprises at least one of Dy and Tb;

b) arranging the arc-shaped Nd—Fe—B magnet and the flexible film such that a first curved surface of the arc-shaped Nd—Fe—B magnet and the heavy rare earth coating on the flexible film are facing each other;

such that a curved surface of the first ceramic body lies on the side of the flexible film opposite the arc-shaped Nd—Fe—B magnet, then pressing the first ceramic body and the magnet together; and d) performing a thermally induced grain boundary diffusion process.

20 Claims, 1 Drawing Sheet

METHOD OF IMPROVING COERCIVITY OF AN ARC-SHAPED ND-FE-B MAGNET

TECHNICAL FIELD

The present disclosure relates to improving performance of NdFeB magnet, and more specifically is about a method of improving coercivity of the arc-shaped NdFeB magnet.

BACKGROUND

Sintered Nd—Fe—B magnets have excellent magnetic properties and are widely used in computers, automobiles, medical treatment and wind power generation. With the development of high-speed wind power and new energy vehicles, there is a need for further improvement of Nd—Fe—B magnets. It is required to maintain high magnetism even at high temperature and high-speed operation, which requires the development of magnets with high remanence and high coercivity. In different application fields, due to the design of the required magnetic field, the Nd—Fe—B magnets will be formed into various shapes to cope with the influence of different application areas. The common shapes can be mainly divided into square and arc shapes.

The Nd—Fe—B magnet is based on the intermetallic compound $Nd_2Fe_{14}B$. By adding Dy, Tb or its alloy at the boundary of the $Nd_2Fe_{14}B$ phase the crystal magnetic anisotropy of the phase is increased and thereby the coercivity of the Nd—Fe—B magnets can be effectively improved. Based on this knowledge, the grain boundary diffusion technology has been widely used in the production of ND-Fe—B magnets due to its excellent performance improvement advantages and high economic value. Different diffusion processes for the grain boundary diffusion have been evolved. However, the commonly used diffusion technology is mainly aimed at square magnets. For arc-shaped magnet, most diffusion technologies cannot be simply applied to it.

CN101375352A of Hitachi Metals Corporation discloses a method of using evaporation, sputtering, and ion plating processes to deposit a heavy rare earth layer and an alloy layer thereof on the surface of Nd—Fe—B magnet and then diffuse the layer compounds into the magnet at high temperature. This method is suitable for improving the coercivity of square-type Nd—Fe—B magnets and arc-shaped Nd—Fe—B magnets. However, the utilization rate of the heavy rare earth elements of Dy and Tb is low, resulting in high cost production costs.

CN103258633A of Yantai Zheng Hai Magnetic Materials Corporation discloses a grain boundary diffusion process including the step of thermally spraying a layer of Dy or Tb on the surface of the Nd—Fe—B magnet and then conducting a diffusion treatment to improve the coercivity of the Nd—Fe—B magnet. This method is suitable for magnets of any shape including square-shaped and arc-shaped magnets. However, using this method, the utilization rate of Dy and Tb is low, resulting in high cost production costs.

JP2018-2390 A of Hitachi Metals Corporation discloses a grain boundary diffusion process based on a screen-printing process including the step of coating a slurry based on heavy rare earth powder and organic solvent on the surface of the magnet and then performing a diffusion aging treatment to improve the coercivity of the Nd—Fe—B magnets. The utilization rate of heavy rare earth materials is very high, but the technical solution of screen-printing cannot be used for coating curved surface of arc-shaped magnets.

SUMMARY

The purpose of the disclosure is to overcome the shortcoming of the above-mentioned technologies and provide a method of improving the coercivity of the arc-shaped Nd—Fe—B magnets. The method shall be simple in operation and easy to use.

In order to achieve the above objectives, the disclosure provides a method for increasing the coercivity of an arc-shaped Nd—Fe—B magnet, said method comprising the steps of:

a) providing of a flexible film with a heavy rare earth coating thereon, wherein the heavy rare earth coating comprises at least one of Dy and Tb;

b) arranging the arc-shaped Nd—Fe—B magnet and the flexible film such that a first curved surface of the arc-shaped Nd—Fe—B magnet and the heavy rare earth coating on the flexible film are facing each other;

c) arranging a first ceramic body such that a curved surface of the first ceramic body lies on the side of the flexible film opposite the arc-shaped Nd—Fe—B magnet, wherein the curved surface of the first ceramic body and the first curved surface of the arc-shaped Nd—Fe—B magnet are of complementary shape, then pressing the first ceramic body and the magnet together; and d) performing a thermally induced grain boundary diffusion process.

The heavy rare earth coating may be formed by screen-printing a layer of a heavy rare earth slurry on a surface of the flexible film, drying and solidifying the slurry to form a heavy rare earth coating, wherein the heavy rare earth slurry is a mixture of a heavy rare earth powder with an organic adhesive and an organic solvent and the heavy rare earth powder comprises or consist of at least one of Dy and Tb.

Subsequent to step c) and before performing step d), the assembly of the arc-shaped Nd—Fe—B magnet and the first ceramic body may be turned by 180° in the vertical direction, and then steps a) through c) may be repeated in the same way as above for pressing a second ceramic body against a second curved surface of the magnet being positioned opposite to the first curved surface of the magnet.

The heavy rare earth power may comprise or consist of at least one of pure Dy, pure Tb, a Dy alloy, a Tb alloy, a Dy compound and a Tb compound. The powder may have an average particle size D50 of 1-200 μm. The average particle diameter of the particles may be for example measured by a laser diffraction device using appropriate particle size standards. Specifically, the laser diffraction device is used to determine the particle diameter distribution of the particles, and this particle distribution is used to calculate the arithmetic average of particle diameters.

The flexible film may be a flexible plastic film or a flexible paper film with a thickness of 0.05-0.2 mm.

A thickness of the arc-shaped Nd—Fe—B magnet may be in the range of 1-15 mm.

A weight ratio of the heavy rare earth powder in the heavy rare earth coating on the surface of the flexible film to the weight of the arc-shaped Nd—Fe—B magnet to be coated may be 0.1%-1.5%.

The curved surface of the arc-shaped Nd—Fe—B magnet may be at least one of a concave or a convex surface. The arc-shaped Nd—Fe—B magnet may preferably include a concave surface and a convex surface.

The first ceramic body, respectively the second ceramic body may be a zirconia ceramic or an alumina ceramic.

The grain boundary diffusion process of step d) may be performed under inert atmosphere or vacuum.

The grain boundary diffusion process of step d) may include a first heat treatment step at 200° C.-400° C. for 2 h-4 h, a second a first heat treatment step at 850° C.-950° C. for 6-72 h, and an aging step at 450° C.-650° C. for 3-15 h.

The organic adhesive may be an adhesive being rubber-elastic-flexible after curing. In particular, the organic adhesive may be a polyurethane-based adhesive. The adhesive may also be a resin adhesive, e.g. an epoxy resin.

The organic solvent may be benzene or a ketone-based or ester-based solvent (or diluent), such as acetone or ethyl acetate.

During the diffusion aging process, the ceramic lower shaped body is always in close contact with the heavy rare earth coating and the arc-shaped Nd—Fe—B magnet.

Compared with the prior art, the present disclosure has the following advantages:

The present disclosure coats the heavy rare earth coating on the flexible film by screen printing, which greatly saves the heavy rare earth material, and then transports the heavy rare earth coating to the surface to be diffused of the arc-shaped Nd—Fe—B magnet through the flexible film. The heavy rare earth coating is closely attached to the arc surface to be modified ensuring a uniform and stable supply of heavy rare earth elements in the subsequent diffusion process. The disclosure has simple operation, high production efficiency, high utilization rate of heavy rare earth powder, and low requirement on the appearance shape of the Nd—Fe—B magnet.

DETAILED DESCRIPTION OF THE EMBODIMENTS

Figure 1:
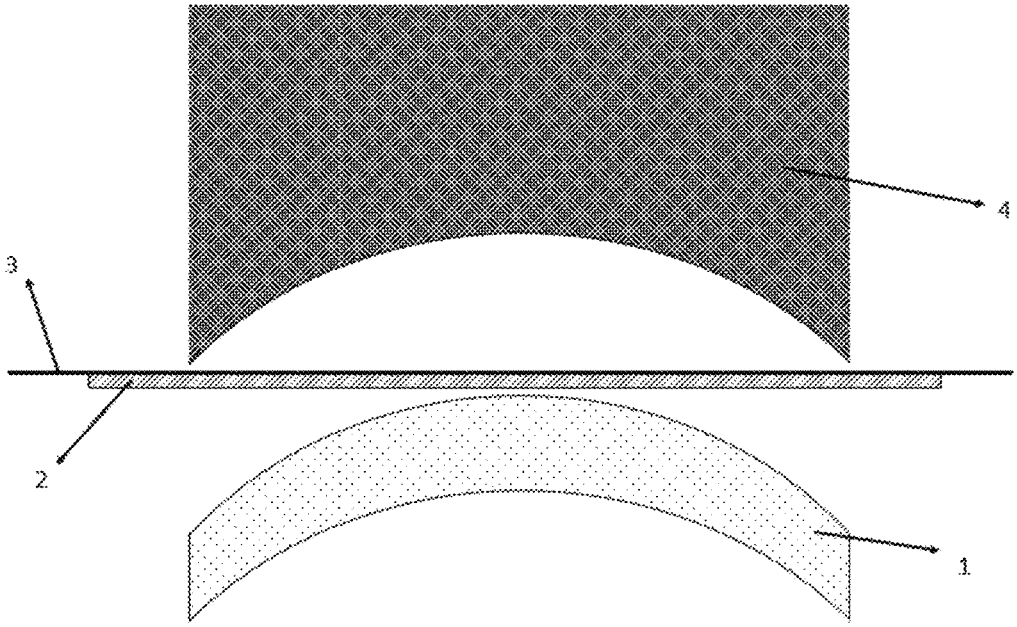
FIG. 1 is a schematic illustration of an arc-shaped Nd—Fe—B magnet with a heavy rare-earth coating applied to one side by extrusion.

In order to make the objectives, technical solutions and advantages of the present disclosure clearer, an embodiment of the present disclosure will be described in further detail below in conjunction with the accompanying drawings.

The heavy rare earth coating is prepared on the surface of the flexible film in advance, and the arc surface of the arc-shaped Nd—Fe—B magnet to be diffused is placed directly under the flexible film with the heavy rare earth coating. By applying pressure on the flexible film, the heavy rare earth coating is attached to the arc surface of the arc-shaped Nd—Fe—B magnet to be diffused, followed by diffusion treatment and aging treatment For the Nd—Fe—B magnet in this application, at least one of the two opposite sides of the arc-shaped Nd—Fe—B magnet is a curved surface, and the curved surface is a concave or convex surface. In this embodiment, the thickness of the arc-shaped Nd—Fe—B magnet is in the range of 1-15 mm, the diffusion effect of the magnet is relatively good within this thickness range.

The flexible film is a flexible plastic film or a flexible paper film with a thickness of 0.05-0.2 mm, which is convenient to bend and fit on the curved surface of the arc-shaped Nd—Fe—B magnet to be diffused when pressure is applied.

The preparation of the heavy rare earth coating is to first prepare a heavy rare earth slurry by mixing heavy rare earth powder with organic adhesives and organic solvents, and screen printing a layer of the heavy rare earth slurry on the surface of the flexible film by screen printing and then drying and solidifying the slurry to form the heavy rare earth coating.

The heavy rare earth powder includes pure metal, an alloy, or a compound powder, the average particle size D50 of the selected pure metal, alloy or compound powder is 1-200 μm.

The organic adhesive may be a resin adhesive or a rubber adhesive, and the organic solvent may be a ketone, benzene or ester diluent.

The weight ratio of the heavy rare earth powder in the heavy rare earth coating on the surface of the flexible film to the weight of the arc-shaped Nd—Fe—B magnet is 0.1%-1.5%.

For increasing the coercivity of the arc-shaped Nd—Fe—B magnet, the method comprises the steps of:

a) providing of the flexible film with the heavy rare earth coating thereon, wherein the heavy rare earth coating comprises at least one of Dy and Tb;

b) arranging the arc-shaped Nd—Fe—B magnet and the flexible film such that a first curved surface of the arc-shaped Nd—Fe—B magnet and the heavy rare earth coating on the flexible film are facing each other;

c) arranging a first ceramic body such that a curved surface of the first ceramic body lies on the side of the flexible film opposite the arc-shaped Nd—Fe—B magnet, wherein the curved surface of the first ceramic body and the first curved surface of the arc-shaped Nd—Fe—B magnet are of complementary shape, then pressing the first ceramic body and the magnet together; and d) performing a thermally induced grain boundary diffusion process.

The heavy rare earth coating may be formed by screen-printing a layer of a heavy rare earth slurry on a surface of the flexible film, drying and solidifying the slurry to form a heavy rare earth coating, wherein the heavy rare earth slurry is a mixture of a heavy rare earth powder with an organic adhesive and an organic solvent and the heavy rare earth powder comprises or consist of at least one of Dy and Tb.

Subsequent to step c) and before performing step d), the assembly of the arc-shaped Nd—Fe—B magnet and the first ceramic body may be turned by 180° in the vertical direction, and then steps a) through c) may be repeated in the same way as above for pressing a second ceramic body against a second curved surface of the magnet being positioned opposite to the first curved surface of the magnet.

According to an embodiment, a heavy rare earth powder is mixed with organic adhesives and organic solvents to prepare heavy rare earth slurry. Screen printing is used to screen a layer of the heavy rare earth slurry on the surface of flexible film, which is then dried and solidified to form a heavy rare earth coating. The heavy rare earth element is Dy or Tb.

Take out the arc-shaped Nd—Fe—B magnet and place the arc to be diffused upward. The flexible film coated with heavy rare earth coating is moved directly above the arc-shaped Nd—Fe—B magnet. The center position of the heavy rare earth coating on the flexible film remains exactly the same as the center position of the arc surface where the arc-shaped NdFeB magnet will diffuse in the vertical direction. The heavy rare earth coating is located between the flexible film and the arc-shaped Nd—Fe—B magnet.

A ceramic lower shaped body is used to apply downward pressure to the flexible film such that the flexible film coated with the heavy rare earth coating is subjected to downward pressure and starts to contact with the arc-shaped NdFeB magnet and gradually adhere to it.

The arc-shaped Nd—Fe—B magnet together with the ceramic lower shaped body is turned by 180° in the vertical direction, then in the same way as mentioned above, a layer of heavy rare earth coating is attached to the arc surface to be diffused on the other side of the arc-shaped Nd—Fe—B magnet.

The arc-shaped Nd—Fe—B magnets is diffused under protection of inert gas or vacuum conditions.

According to an embodiment, the heavy rare earth coating on the flexible film is moved to the arc-shaped Nd—Fe—B magnet directly above the arc surface to be diffused before being extruded, and the center position of the heavy rare-earth coating and the arc-shaped Nd—Fe—B magnet is maintained. The heavy rare-earth coating on the flexible film is consistent with the shape and surface area of the arc surface of the arc-shaped Nd—Fe—B magnet to be diffused.

According to an embodiment, the shape of the extrusion surface of the ceramic lower shaped body is a shape that closely fits the arc surface to be diffused of the arc-shaped Nd—Fe—B magnet, and the ceramic lower shaped body is always in contact with the heavy rare earth coating during the diffusion aging process. It is closely attached to the arc-shaped Nd—Fe—B magnet to be diffused, and the material of the ceramic lower shaped body is zirconia ceramic or alumina ceramic.

According to an embodiment, diffusion treatment is divided into first diffusion and secondary diffusion. The diffusion temperature of first diffusion is 200° C.-400° C., the diffusion time is 2 h-4 h, and the diffusion temperature of secondary diffusion is 850-950° C., the diffusion time is 6-72 h, the aging temperature is 450-650° C., and the aging time is 3-15 h.

Example 1

Figure 2:
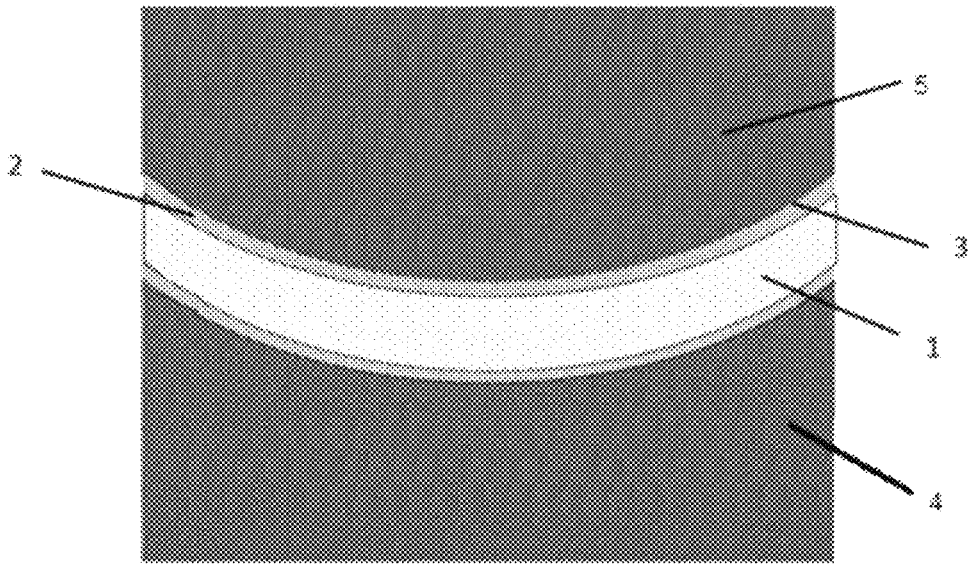
FIG. 2 is a schematic illustration of an arc-shaped Nd—Fe—B magnet with heavy rare earth coatings extruded on both sides.

Referring to FIG. 1 and FIG. 2, the method for increasing the coercivity of arc-shaped Nd—Fe—B magnets includes the following steps:

Pure Dy powder with an average particle size of 1 μm is mixed with a resin adhesive (epoxy resin) and benzene as diluent to form heavy rare earth slurry. A layer of the heavy rare earth slurry is coated on a flexible film using a screen-printing technology. The flexible film has a thickness of 0.05 mm and is a flexible paper film. By controlling the amount of coated material and of the pattern and mesh of the screen, the shape, surface area and thickness of the coated heavy rare earth slurry could be controlled. The coated slurry is dried and solidified to form a heavy rare earth coating. The shape and surface area of the coating should be the same as the curved surface of the magnet. A weight ratio of the heavy rare earth powder in the heavy rare earth coating on the surface of the flexible film to the weight of the arc-shaped Nd—Fe—B magnet is 0.1% by weight.

As shown in FIG. 1, the arc-shaped Nd—Fe—B magnet with a thickness of 1 mm is placed below the flexible film 3 with the coating 2 such that its convex surface is facing upwards. The heavy rare earth coating 2 is located between the flexible film 3 and the arc Nd—Fe—B magnet 1. A first ceramic body 4 having a concave surface is positioned above the flexible film 3 such that the concave surface faces the flexible film 3. The concave surface of the first ceramic body 4 and the convex surface of the magnet 1 are of complementary shape. When the first ceramic body 4 is moved downwards, the flexible film 3 with the coating 2 is bent towards and pressed against the concave surface of the magnet 1, which shall be modified by the grain boundary diffusion process.

To modify also the opposite concave surface of the magnet 1 by the grain boundary diffusion process, the arc-shaped Nd—Fe—B magnet 1 is turned together with the first ceramic body 4 by 180° in the vertical direction so that the concave surface of the arc-shaped Nd—Fe—B magnet 1 faces upwards. Using the same method as above, a coating 2 on a flexible film 3 is bent towards and pressed against the concave surface of the arc-shaped Nd—Fe—B magnet 1. However, a second ceramic body 5 having a convex surface is positioned above the flexible film 3 such that the convex surface faces the flexible film 3. The convex surface of the second ceramic body 5 and the concave surface of the magnet 1 are of complementary shape. The ceramic bodies 4 and 5 are made of zirconia.

After that, the arc-shaped Nd—Fe—B magnet with heavy rare earth coatings attached to the concave and convex surfaces is subjected to a grain boundary diffusion process under vacuum or inert conditions. Said process includes a first heat treatment step at 200° C. for 2 h, a second heat treatment step at 850° C. for 6 h, and an aging treatment at 450° C. for 3 h.

After the diffusion process is completed, the magnetic properties of the arc-shaped Nd—Fe—B magnet is tested, and the magnetic properties of the arc-shaped Nd—Fe—B magnet before diffusion is used as Comparative Example 1. The above test results are filled in Table 1 to compare and confirm the diffusion effects of the arc-shaped Nd—Fe—B magnets after diffusion.

TABLE 1

| | Br(T) | Hcj(kA/m) | Hk/Hcj |
|---|---|---|---|
| Comparative Example 1 | 1.42 | 1330 | 0.98 |
| Example 1 | 1.42 | 1576 | 0.98 |

Analysing Table 1, it can be seen that remanence and squareness ratio of the arc-shaped Nd—Fe—B magnet of Example 1 do not change, but the coercivity increases by 246 kA/m.

Example 2

The production is similar to Example 1 except for the following differences. In this embodiment, the heavy rare earth coating is formed on the flexible film with a thickness of 15 mm. Pure Tb powder with an average particle size of 100 μm is mixed with a rubber adhesive (polyurethane-based adhesive) and a ketone diluent (acetone) to form the heavy rare earth slurry. The flexible plastic film has a thickness of 0.2 mm, and the weight ratio of heavy rare earth powder to the weight of the arc magnet to be coated is 1.5%. The diffusion process includes a first heat treatment step at 200° C. for 4 h, a second heat treatment step at 850° C. for 72 h, and an aging treatment at 550° C. for 15 h.

After the diffusion process is completed, the magnetic properties of the arc-shaped Nd—Fe—B magnet is tested, and the magnetic properties of the arc-shaped Nd—Fe—B magnet before diffusion is used as Comparative Example 2.

The above test results are filled in Table 2 to compare and confirm the diffusion effects of the arc-shaped Nd—Fe—B magnets after diffusion.

TABLE 2

| | Br(T) | Hcj(kA/m) | Hk/Hcj |
|---|---|---|---|
| Comparative Example 2 | 1.39 | 1202 | 0.98 |
| Example 2 | 1.36 | 1950 | 0.97 |

Analysing Table 2, it can be seen that in the arc-shaped Nd—Fe—B magnet of Example 2, the remanence is reduced by 0.3 T, the coercivity increases by 748 kA/m and the squareness ratio does not change.

Example 3

The production is similar to Example 1 except for the following differences. In this embodiment, the heavy rare earth coating is formed on an arc-shaped Nd—Fe—B magnet with a thickness of 8 mm. The coating on the flexible film is prepared with a slurry including TbH powder with an average particle size of 200 μm, which is mixed with a resin binder (epoxy resin) and an ester diluent (ethyl acetate). The flexible film is a flexible plastic film with a thickness of 0.2 mm, and the weight ratio of heavy rare earth powder to the weight of the arc magnet to be coated is 1.0%. The diffusion process includes a first heat treatment step at 400° C. for 4 h, a second heat treatment step at 900° C. for 30 h, and an aging treatment at 650° C. for 8 h.

After the diffusion process is completed, the magnetic properties of the arc-shaped Nd—Fe—B magnet is tested, and the magnetic properties of the arc-shaped Nd—Fe—B magnet before diffusion is used as Comparative Example 3. The above test results are filled in Table 3 to compare and confirm the diffusion effects of the arc-shaped Nd—Fe—B magnets after diffusion.

TABLE 3

| | Br(T) | Hcj(kA/m) | Hk/Hcj |
|---|---|---|---|
| Comparative Example 3 | 1.42 | 1330 | 0.98 |
| Example 3 | 1.40 | 2006 | 0.97 |

Analysing Table 3, it can be seen that in the arc-shaped Nd—Fe—B magnet of Example 3, the remanence is reduced by 0.2 T, the coercivity increases by 676 kA/m and the squareness ratio does not change.

Example 4

The production is similar to Example 1 except for the following differences. In this embodiment, the heavy rare earth coating is formed on an arc-shaped Nd—Fe—B magnet with a thickness of 5 mm. TbCu alloy powder with an average particle size of 100 μm is mixed with a resin binder (epoxy resin) and an ester diluent (ethyl acetate) to form the heavy rare earth slurry. A screen-printing technology with a flexible plastic film having a thickness of 0.12 mm is used, and the weight ratio of heavy rare earth powder to the weight of the arc magnet to be coated is 1.0%. The diffusion process includes a first heat treatment step at 400° C. for 4 h, a second heat treatment at 950° C. for 6 h, and an aging treatment at 650° C. for 5 h.

After the diffusion process is completed, the magnetic properties of the arc-shaped Nd—Fe—B magnet is tested, and the magnetic properties of the arc-shaped Nd—Fe—B magnet before diffusion is used as Comparative Example 4. The above test results are filled in Table 4 to compare and confirm the diffusion effects of the arc-shaped Nd—Fe—B magnets after diffusion.

TABLE 4

| | Br(T) | Hcj(kA/m) | Hk/Hcj |
|---|---|---|---|
| Comparative Example 4 | 1.42 | 1330 | 0.98 |
| Example 4 | 1.40 | 1934 | 0.97 |

Analysing Table 4, it can be seen that in the arc-shaped Nd—Fe—B magnet of Example 4, the remanence is reduced by 0.2 T, the coercivity increases by 604 kA/m and the squareness ratio does not change.

It can be seen from the above embodiments that the heavy rare earth coating can be successfully bonded on the arc surface of the arc-shaped Nd—Fe—B magnet and then be diffused into the magnet body by the method of the present application. The coercivity of the Nd—Fe—B magnets is significantly improved and the remanence of the Nd—Fe—B magnets decrease very little.

What is claimed is:

1. A method for increasing the coercivity of an arc-shaped Nd—Fe—B magnet, said method comprising the steps of:

a) providing of a flexible film with a heavy rare earth coating thereon, wherein the heavy rare earth coating comprises at least one of Dy and Tb;

b) arranging the arc-shaped Nd—Fe—B magnet and the flexible film such that a first curved surface of the arc-shaped Nd—Fe—B magnet and the heavy rare earth coating on the flexible film are facing each other;

c) arranging a first ceramic body such that a curved surface of the first ceramic body lies on the side of the flexible film opposite the arc-shaped Nd—Fe—B magnet, wherein the curved surface of the first ceramic body and the first curved surface of the arc-shaped Nd—Fe—B magnet are of complementary shape, then pressing the first ceramic body and the magnet together; and d) performing a thermally induced grain boundary diffusion process.

2. The method of claim 1, wherein the heavy rare earth coating is formed by screen-printing a layer of a heavy rare earth slurry on a surface of the flexible film, drying and solidifying the slurry to form a heavy rare earth coating, wherein the heavy rare earth slurry is a mixture of a heavy rare earth powder with an organic adhesive and an organic solvent and the heavy rare earth powder comprises or consist of at least one of Dy and Tb.

3. The method of claim 2, wherein the heavy rare earth power comprises or consists of at least one of pure Dy, pure Tb, a Dy alloy, a Tb alloy, a Dy compound and a Tb compound.

4. The method of claim 2, wherein a weight ratio of the heavy rare earth powder in the heavy rare earth coating on the surface of the flexible film to the weight of the arc-shaped Nd—Fe—B magnet to be coated is 0.1%-1.5%.

5. The method of claim 2, wherein the organic adhesive is an adhesive being rubber-elastic-flexible after curing.

6. The method of claim 2, wherein subsequent to step c) and before performing step d), the assembly of the arc-shaped Nd—Fe—B magnet and the first ceramic body is turned by 180° in the vertical direction, and then steps a) through c) are repeated in the same way as above for pressing a second ceramic body against a second curved surface of the magnet being positioned opposite to the first curved surface of the magnet.

7. The method of claim 2, wherein a thickness of the arc-shaped Nd—Fe—B magnet is in the range of 1-15 mm.

8. The method of claim 2, wherein the flexible film is a flexible plastic film or a flexible paper film with a thickness of 0.05-0.2 mm.

9. The method of claim 2, wherein the curved surface of the arc-shaped Nd—Fe—B magnet is at least one of a concave surface or a convex surface.

10. The method of claim 1, wherein subsequent to step c) and before performing step d), the assembly of the arc-shaped Nd—Fe—B magnet and the first ceramic body is turned by 180° in the vertical direction, and then steps a) through c) are repeated in the same way as above for pressing a second ceramic body against a second curved surface of the magnet being positioned opposite to the first curved surface of the magnet.

11. The method of claim 10, wherein each of the first ceramic body and the second ceramic body is a zirconia ceramic or an alumina ceramic.

12. The method of claim 10, wherein a thickness of the arc-shaped Nd—Fe—B magnet is in the range of 1-15 mm.

13. The method of claim 10, wherein the flexible film is a flexible plastic film or a flexible paper film with a thickness of 0.05-0.2 mm.

14. The method of claim 10, wherein the curved surface of the arc-shaped Nd—Fe—B magnet is at least one of a concave surface or a convex surface.

15. The method of claim 1, wherein a thickness of the arc-shaped Nd—Fe—B magnet is in the range of 1-15 mm.

16. The method of claim 15, wherein the flexible film is a flexible plastic film or a flexible paper film with a thickness of 0.05-0.2 mm.

17. The method of claim 1, wherein the flexible film is a flexible plastic film or a flexible paper film with a thickness of 0.05-0.2 mm.

18. The method of claim 1, wherein the curved surface of the arc-shaped Nd—Fe—B magnet is at least one of a concave surface or a convex surface.

19. The method claim 1, wherein the grain boundary diffusion process of step d) is performed under inert atmosphere or vacuum.

20. The method of claim 1, wherein the grain boundary diffusion process of step d) includes a first heat treatment step at 200° C.-400° C. for 2 h-4 h, a second a first heat treatment step at 850° C.-950° C. for 6-72 h, and an aging step at 450° C.-650° C. for 3-15 h.

* * * * *